US007163422B2

(12) United States Patent
Amano et al.

(10) Patent No.: US 7,163,422 B2
(45) Date of Patent: Jan. 16, 2007

(54) PROTECTION OF HARD DRIVE INTERFACE CONNECTOR

(75) Inventors: Yoshiroh Amano, Kanagawa (JP); Kohji Takahashi, Kanagawa (JP)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 0 days.

(21) Appl. No.: 11/218,389

(22) Filed: Sep. 2, 2005

(65) Prior Publication Data

US 2006/0052006 A1 Mar. 9, 2006

(30) Foreign Application Priority Data

Sep. 6, 2004 (JP) ..... 2004-258962

(51) Int. Cl.
*H01R 25/00* (2006.01)

(52) U.S. Cl. ..... 439/638; 439/567

(58) Field of Classification Search ..... 439/638, 439/639, 609, 83, 570, 566, 326, 64, 630, 439/328, 329

See application file for complete search history.

(56) References Cited

U.S. PATENT DOCUMENTS 4,908,715 A * 3/1990 Krum et al. ..... 360/97.02
5,419,713 A * 5/1995 Northey ..... 439/567
5,921,811 A * 7/1999 Hsu ..... 439/567
5,967,846 A * 10/1999 Davis et al. ..... 439/609
6,270,375 B1 * 8/2001 Cox et al. ..... 439/493
6,428,330 B1 * 8/2002 Poulter et al. ..... 439/76.1
6,519,110 B1 * 2/2003 Dague et al. ..... 360/97.01
6,793,541 B1 * 9/2004 Yamaguchi et al. ..... 439/751
6,796,835 B1 * 9/2004 Wu ..... 439/567
6,884,112 B1 * 4/2005 Juntwait et al. ..... 439/573
6,900,962 B1 * 5/2005 Forbord ..... 360/97.02

FOREIGN PATENT DOCUMENTS

JP 2003-257567 A 9/2003

* cited by examiner

*Primary Examiner*—Hae Moon Hyeon
*Assistant Examiner*—Harshad C. Patel
(74) *Attorney, Agent, or Firm*—Townsend and Townsend and Crew, LLP

(57) ABSTRACT

Damage of a connection between a connector and a circuit board on which the connector is mounted is to be prevented at the time of connecting the connector with a corresponding connector on a host side. In one embodiment, an HDD is provided with a serial ATA connector. The connector is mounted on a circuit board. The HDD is also provided with stiffeners for fixing the connector to the circuit board. When the connector moves toward a base at the time of connection thereof to a host-side connector, the stiffeners come into abutment against the base to stop the movement of the connector. As a result, damage of the connection between the connector and the circuit board can be prevented.

18 Claims, 11 Drawing Sheets

PROTECTION OF HARD DRIVE INTERFACE CONNECTOR

CROSS-REFERENCES TO RELATED APPLICATIONS

This application claims priority from Japanese Patent Application No. JP2004-258962, filed Sep. 6, 2004, the entire disclosure of which is incorporated herein by reference.

BACKGROUND OF THE INVENTION

The present invention relates to a data storage device, a connector, and a magnetic disk drive. In particular, the present invention is suitable for a hard disk drive provided with a serial Advanced Technology Attachment (SATA) connector.

Devices using various types of media such as optical disks and magnetic tapes are known as information recording and reproducing devices. Among them, hard disk drives (HDDs) have become popular as storage devices for computers to such an extent that they are one of the storage devices indispensable for today's computers. Further, not limited to computers, their application is widening more and more due to the superior characteristics with the advent of moving picture recording/reproducing devices, car navigation systems, removable memories for digital cameras and so on.

Each magnetic disk used in HDDs has a plurality of tracks formed concentrically and each track is partitioned into a plurality of sectors. In each sector, sector address information and user data are stored. Either data written to a sector or data read from the sector is enabled by a magnetic head which accesses the desired sector according to the sector address information. A signal read out from a magnetic disk through a data read operation is subjected to waveform shaping, decoding processing and other prescribed signal processing by a signal processing circuit before transmitted to the host. Likewise, data transferred from the host is subjected to prescribed signal processing by a signal processing circuit and then written to the magnetic disk.

As an interface for data transfer between a host such as a computer and an HDD there usually is employed such a protocol as SCSI (Small Computer System Interface) or ATA ( Advanced Technology Attachment) Interface. In particular, from the standpoint of improving the interface function and attaining a reduction of cost, the ATA interface is utilized in many computers and is also widely utilized as an interface in other types of storage devices such as optical disk storage devices. With the demand for improving the recording density and improving the performance, the demand for the data transmission rate of the ATA interface is becoming more and more strict. Therefore, ATA interface (serial ATA) using serial transmission instead of the conventional parallel transmission has been proposed.

A standard for serial ATA is being established by "Serial ATA Working Group." In "Serial ATA II: Extensions to Serial ATA 1.0 Specification," several techniques not found in the conventional parallel ATA are adopted. With the change from parallel to serial transmission method, the structure of the connector for connecting the HDD to a host such as a PC is also being modified greatly.

For example, in Patent Literature 1 (Japanese Patent Laid-open No. 2003-257567), an impedance tuning type connector for diminishing the percent of product defect is proposed as a connector conforming to the Serial ATA Interface. The impedance tuning type connector is provided with an insulating housing and plural signal terminals disposed in the insulating housing, each terminal having a connector portion and a pin portion. A pit portion is disposed between two adjacent contact portions of signal terminals and one signal terminal is separated with air from the adjacent signal terminals. Since the dielectric constant of air is lower than that of plastics, the capacitance between the two signal terminals decreases, but the impedance between them is presumed to become high.

BRIEF SUMMARY OF THE INVENTION

In designing a connector, a structural design is important in addition to the electrical design as disclosed in Patent Literature 1. The connector on the HDD side is mounted on a circuit board of the HDD. Typically, the circuit board is fixed to an outer surface of a base which constitutes the enclosure of the HDD. When a user connects the HDD-side connector to a host-side connector, a large force may be exerted on the HDD-side connector. When a large force is applied to the HDD-side connector, the connection between connecting terminals of the connector and the circuit board may be damaged. In particular, a force applied in a direction to peel the connector from the circuit board increases such connection damage.

FIG. 11 shows a connector structure in a conventional parallel ATA. A connector 51 is mounted on a circuit board 52. The connector 51 has a housing 511 and plural connecting terminals 512 fixed to the housing. The connecting terminals 512 are soldered to the circuit board 52 and are projected from the housing 511. For connection to a host-side connector, the connecting terminals 512 projecting from the housing 511 are inserted into connecting holes formed on the host side, whereby an electrical contact is effected and the connectors are fixed to each other.

On the other hand, in connecting a serial ATA connector, housings of the HDD-side and host-side connectors are fitted with each other (as to this point, a detailed description will be given later in "Detailed Description of the Invention"). Therefore, in comparison with the parallel ATA connector structure, the serial ATA connector structure affords a more positive connection between connectors, and a larger force is easy to be applied to the HDD-side connector. Thus, it is necessary to improve the serial ATA connector so that the connector is properly fixed to the circuit board.

The present invention has been accomplished with the above-mentioned circumstances as background and it is a feature of the invention to improve the fixing between a circuit board and a connector.

A data storage device in a first aspect of the present invention comprises a data storage device body; a circuit board mounted on the data storage device body; a connector mounted on the circuit board, the connector having a housing and a plurality of connecting terminals disposed in the housing; and a stopper adapted to come into abutment against a wall portion opposed to the housing to stop movement of the housing when the housing moves in a direction away from a surface of the circuit board. With the stopper, it is possible to restrict movement of the housing and suppress damage of the connection between the connector and the circuit board.

In specific embodiments, the stopper is formed separately from the housing, is fixed to the circuit board, is fitted with the housing, and fixes the connector to the circuit board. Since the stopper functions as a stiffener for fixing the connector to the circuit board, it is possible to effectively restrict the movement of the connector and fix the connector to the circuit board. It is also possible to reduce the number of parts. Preferably, the height of the stopper from the circuit board is higher than a highest position of the housing. In this case, it is possible to diminish a moving range of the housing.

In some embodiments, the housing has a base portion to which the plural connecting terminals are fixed and a side wall portion formed sideways of the base portion, the plural connecting terminals are arranged on the base portion and have contact portions projecting forward from the base portion so as to be connected to a corresponding connector, and the stopper is fitted in a hole formed in the side wall portion and is opposed to the contact portions in the direction in which the plural connecting terminals are arranged. Since the stopper for fixing the connector is thus disposed, it is possible to effectively restrict the movement of the connector and fix the connector to the circuit board.

Preferably, the side wall portion has a fitting hole for fitting therein of a housing of the corresponding connector which is connected to the above connector, the fitting hole being formed at a position opposed to the contact portions, and the height of the stopper from the circuit board is higher than a highest position of the side wall portion. Since the stopper is fitted in the fitting hole formed in the side wall portion, the packaging area of the circuit board can be utilized effectively and the housing can be fixed firmly. Moreover, since the stopper is higher than the side wall portion, the movement of the housing can be restricted effectively.

The present invention is particularly effective in the case where the housing of the corresponding connector connected to the above connector and the housing of the above connector are fitted together. The data storage device body may have an enclosure for receiving a recording medium therein, the circuit board may be disposed on an outer surface of the enclosure so that the connector is disposed to the enclosure, and the wall portion opposed to the housing may be a part of the enclosure.

In specific embodiments, the connector is disposed on one side of the circuit board, the circuit board is fixed to the enclosure with screws at both corner portions of the one side, and a hole for fitting therein of the stopper is formed in the circuit board so that the center thereof is positioned on a line joining positions innermost from the circuit board end on the one side where screw heads in both corner portions are located, or on the circuit board end side relative to the line. According to this construction, the connector can be fixed more firmly to the circuit board.

Preferably, the center of the stopper fitting hole formed in the circuit board is positioned on a line joining the centers of holes formed in the circuit board for fitting therein of the screws in the both corner portions, or on the circuit board end side relative to the line.

A data storage device in a second aspect of the present invention comprises a data storage device body having an enclosure for receiving a recording medium therein; a circuit board disposed on a surface of the enclosure; a connector disposed on one side of the circuit board, the connector having a housing and a plurality of connecting terminals disposed in the housing; and a stiffener fixed to the circuit board and fitted with the housing, the stiffener fixing the connector to the circuit board; wherein the circuit board is fixed to the enclosure with screws at both corner portions on the one side, and a hole for fitting therein of the stiffener is formed in the circuit board so that the center thereof is positioned on a line joining positions innermost from the circuit board end on the one side where screw heads in the both corner portions are located, or on the circuit board end side relative to the line. Since the hole formed in the circuit board for fitting therein of the stiffener is positioned as above, the connector can be fixed to the circuit board more firmly.

Preferably, the center of the stiffener fitting hole formed in the circuit board is positioned on a line joining the centers of holes formed in the circuit board for fitting therein of the screws in the both corner portions, or on the circuit board end side relative to the line.

In a third aspect of the present invention there is provided a connector fixed to a circuit board at a position opposed to an enclosure which is for receiving therein a recording medium of a data storage device, the circuit board being disposed on a surface of the enclosure, the connector comprising a housing; a plurality of connecting terminals disposed in the housing; and a projecting member fitted in a hole formed in the housing and projecting higher than a highest position of a surface of the housing for mounting to the circuit board. Thus, it is possible to suppress damage of the connection between the connector and the circuit board when the connector is mounted on the circuit board.

A magnetic disk drive in a fourth aspect of the present invention comprises an enclosure which receives a magnetic disk therein and which has a base and a top cover; a circuit board disposed outside the base and with a control circuit mounted thereon; a connector mounted on the circuit board, the connector having a housing and a plurality of connecting terminals disposed in the housing; and a stiffener fixed to the circuit board and fixing the housing to the circuit board, wherein the housing has a base portion on which the plural connecting terminals are arranged and a side wall portion formed sideways of the base portion, the plural connecting terminals having contact portions projecting forward from the base portion so as to be connected to a host-side connector, the stiffener is fitted in a hole formed in the side wall portion, is opposed to the contact portions in the direction in which the plural connecting terminals are arranged, and projects from a surface of the side wall portion opposed to the base, and the distance between the stiffener and the base of the enclosure is smaller than a smallest gap between the side wall portion and the base of the enclosure. With the stiffener constructed as above, it is possible to suppress damage of the connection between the connector and the circuit board.

According to the present invention it is possible to improve the fixing between the circuit board and the connector.

DETAILED DESCRIPTION OF THE INVENTION

Figure 1:
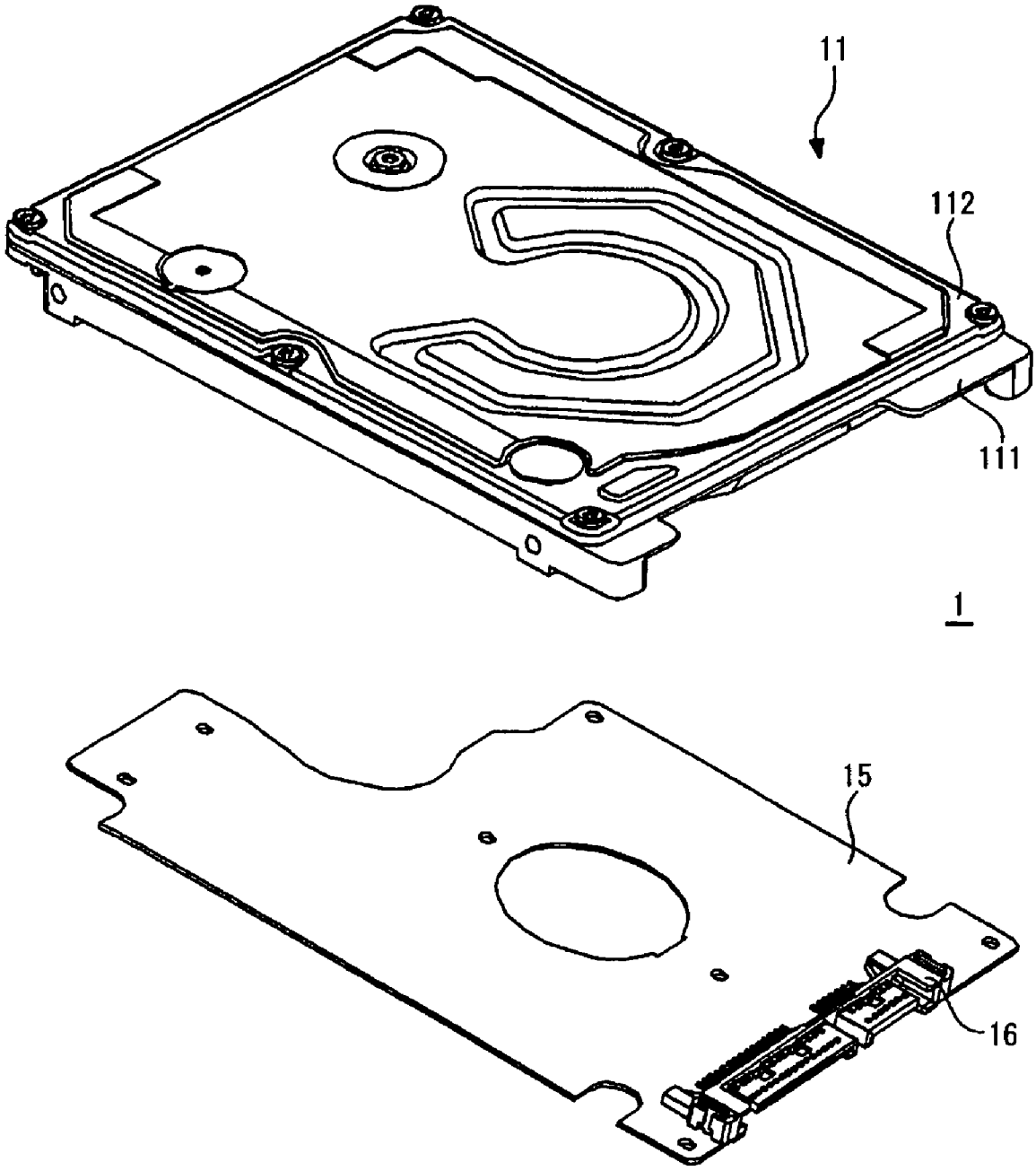
FIG. 1 is an exploded perspective view showing a schematic construction of a hard disk drive according to an embodiment of the present invention.

An embodiment of the present invention will be described hereinunder. The following description is for explaining an embodiment of the present invention and the invention is not limited to the following embodiment. To make the explanation clear, omissions and simplifications are made as necessary in the following description and the accompanying drawings. Any person skilled in the art can easily make modifications, additions and changes with respect to elements used in the following embodiment within the scope of the present invention. In the drawings, like elements are identified by like reference numerals, and tautological explanations will be omitted as necessary for making the explanation clear.

A hard disk drive (hereinafter referred to as "HDD") of this embodiment is provided with a connector conforming to the Serial ATA (AT Attachment) Interface. The connector is mounted on a circuit board. In connecting a connector on an HDD side to a corresponding connector on a host side (e.g., personal computer), a large force may be applied to the HDD-side connector, with consequent likelihood of damage to the connection between connecting terminals of the connector and the circuit board.

The HDD of this embodiment has a stopper for stopping movement of the connector caused by an external force. Consequently, it is possible to diminish the amount of movement of the connector and hence possible to prevent damage of the connection between the connector and the circuit board. In this embodiment, a stiffener for fixing the connector to the circuit board functions as a stopper. The position where the stopper is fixed to the circuit board is set to an appropriate position so that the connector can be fixed more positively.

FIG. 1 is an exploded perspective view showing a schematic construction of an HDD as an example of a data storage device according to the present invention. The HDD, indicated at 1, includes an HDD body 11 and a circuit board 15 mounted on the HDD body 11. The HDD body 11 accommodates various constituent elements within an enclosure which is composed of a base 111 and a top cover 112. The base 111 accommodates the constituent elements of the HDD 1 and is fixed to the top cover 112 through a gasket (not shown), the top cover 112 closing an upper opening of the base 111, whereby the constituent elements of the HDD body 11 can be accommodated in a hermetically sealed state within the enclosure.

A connector 16 is mounted on the circuit board 15. The connector 16 is disposed on one side of the circuit board 15 and is fixed to the circuit board. A recess is formed on one side of the circuit board 15 and the connector 16 is mounted on the circuit board 15 so as to be fitted in the recess. One side of the connector 16 extends along the one side of the circuit board 15, both of those sides being substantially aligned with each other. The connector 16 used in this embodiment has a structure conforming to the Serial ATA Interface.

A detailed description of the structure of the connector 16 and how to fix the connector 16 to the circuit board 15 will be given later. Various circuit elements, including ICs, for controlling the body of the HDD 11 and for controlling data communication between a host and the HDD 11 are mounted on the circuit board 15. For example, various ICs, including HDC (Hard Disk Controller)/MPU, read/write channel, and motor driver, are mounted on a surface on the HDD body 11 side of the circuit board 15. However, the circuit elements on the circuit board 15 are omitted in FIG. 1.

Figure 2:
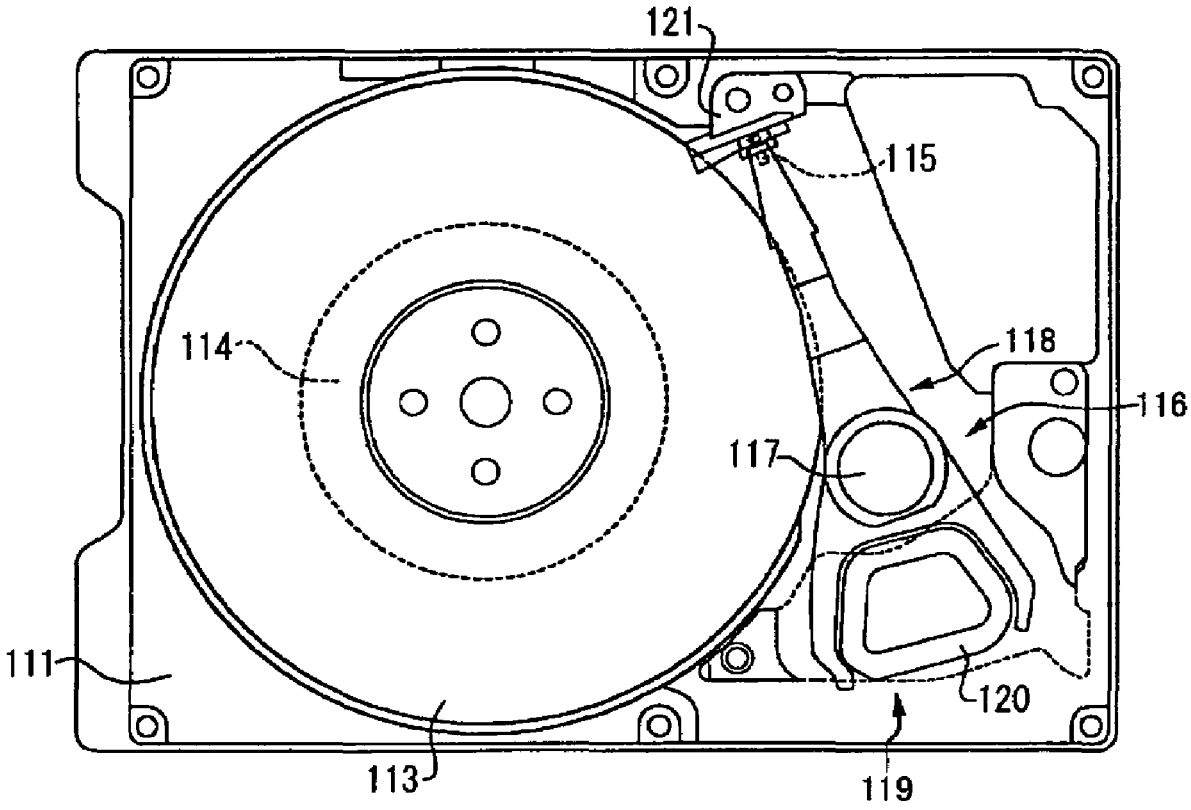
FIG. 2 is a plan view showing schematically an internal construction of a body of the hard disk drive.

Before giving an explanation of the connector 16, the HDD body 11 will be described first. FIG. 2 is a plan view showing schematically an internal construction of the HDD body 11. In the same figure, the numeral 113 denotes a magnetic disk as a non-volatile recording medium which writes data by magnetization of a magnetic layer. The magnetic disk 113 is fixed to a spindle motor 114. The spindle motor 114 rotates the magnetic disk 113 at a predetermined speed. Numeral 115 denotes a head for writing and/or reading data inputted/outputted between the host and the HDD to/from the magnetic disk 113. The head 115 includes a write element for converting an electric signal into a magnetic field in accordance with data to be stored to the magnetic disk 113 and/or a read element for converting a magnetic field provided from the magnetic disk 113 into an electric signal. The head 115 further includes a slider with the write element and/or the read element formed on a surface thereof.

The head 115 is held by an actuator 116. The actuator 116 is held pivotably by a pivot shaft 117 and is provided with a carriage 118 and a VCM (Voice Coil Motor) 119. In the drawing, the VCM 119 is partially cut out for convenience sake and the profile thereof is indicated with a broken line. In accordance with a drive signal fed from a circuit on the circuit board 15 to a flat coil 120, the VCM 119 pivots the carriage 118 about the pivot shaft 117, causing the head 115 to move to a position over the magnetic disk 113 which is rotating.

When the rotation of the magnetic disk 113 stops, the VCM 119 moves the head 115 to the outside of the magnetic disk 113, and the actuator 116 causes the head 115 to be unloaded off of the magnetic disk 113 back onto a ramp mechanism 121. A CSS (Contact Start and Stop) method is also known in which, when the head 115 performs neither write nor read of data, the head is placed to a zone located in the inner periphery of the magnetic disk 113. Though not clearly shown in FIG. 1, the HDD body 11 includes a plurality of stacked magnetic disks. Typically, data are stored on both surfaces of each magnetic disk. Further, plural heads corresponding respectively to recording surfaces of the magnetic disks are held by the actuator 116.

Figure 3:
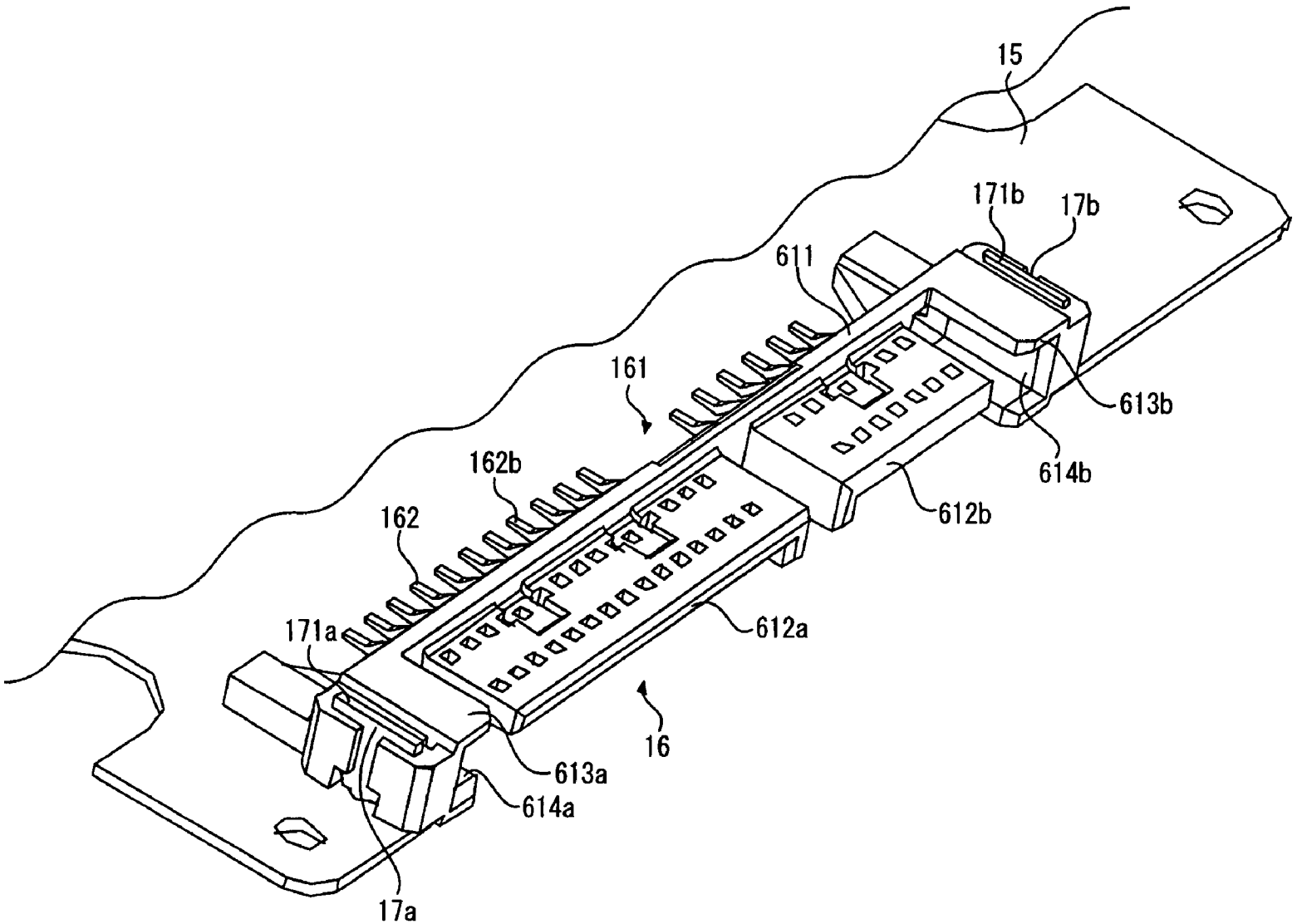
FIG. 3 is a perspective view showing the construction of a serial ATA connector used in the embodiment.
Figure 4:
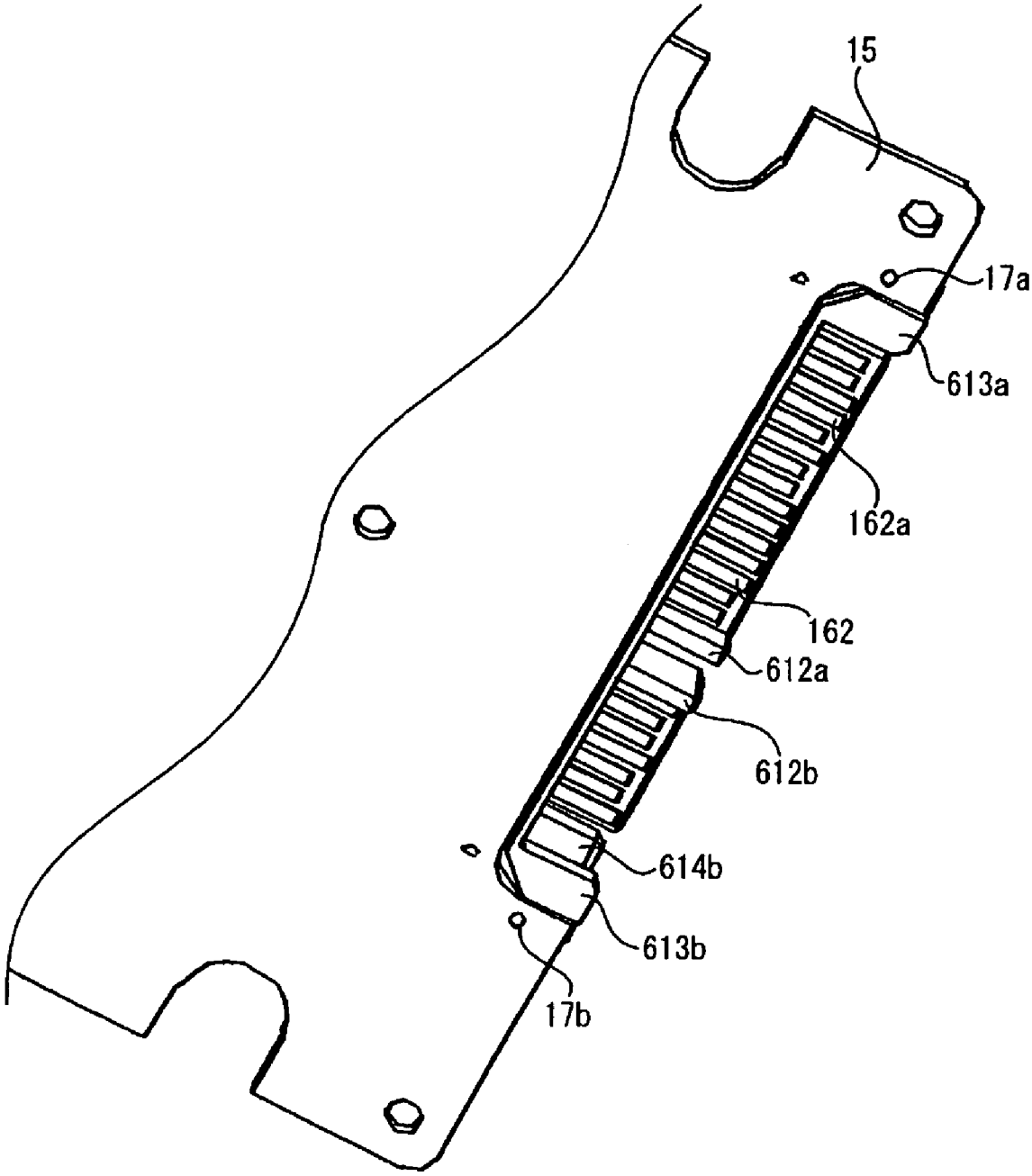
FIG. 4 is a perspective view showing the construction of the serial ATA connector.

Next, a description will be given about the connector 16 mounted on the circuit board 15. FIGS. 3 and 4 are perspective views showing a connection to a host in the circuit board 15, of which FIG. 3 shows the circuit board 15 as seen from the side (base 111 side) where the connector 16 is mounted and FIG. 4 shows the circuit board 15 as seen from the opposite side. As shown in FIG. 3, the connector 16 is mounted on one side of the circuit board 15 and two stiffeners 17*a* and 17*b* for fixing the connector 16 to the circuit board 15 are mounted on the circuit board 15. In this embodiment, two stiffeners 17*a* and 17*b* which fix the connector 16 at both-side wall portions of the connector 16 are used to fix the connector 16 to the circuit board 15 more firmly. In the following description, the stiffeners 17*a* and 17*b* will be generically designated stiffeners 17.

The connector 16 has an insulating housing 161 formed of resin. The housing 161 includes a base portion 611 erected on the circuit board 15 and extending along a side of the circuit board 15 and two plate-like projecting portions 612*a* and 612*b* projecting forward (parallel to the surface of the circuit board 15 and toward the outside of the circuit board 15) from the base portion 611. The housing 161 further includes side wall portions 613*a* and 613*b* on both sides of the projecting portions 612*a* and 612*b*. In the following description, the projecting portions 612*a* and 612*b* will be generically designated projecting portions 612 and the side wall portions 613*a* and 613*b* will be generically designated side wall portions 613.

The connector 16 includes plural connecting terminals 162 disposed within the housing 161. The plural connecting terminals 162 are arranged along a side of the circuit board 15 (in a direction substantially perpendicular to the direction of connection with the corresponding connector of a host). The connecting terminals 162 respectively include contact portions 162*a* (see FIG. 4) for contact with connecting terminals of the corresponding connector on the host side and connecting portions 162*b* (see FIG. 3) to be connected to the circuit board 15. As shown clearly in FIG. 4, the contact portions 162*a* are fixed to the projecting portions 612.

The two projecting portions 612*a* and 612*b* are formed separately. One projecting portion 612*a* holds contact portions 162*a* belonging to a power supply system, while the other projecting portion 612*b* holds contact portions 162*a* belonging to a signal system. The connecting terminals 162 extend from the projecting portions 612 toward the circuit board 15 through through-holes formed in the base portion 611 and the connecting portions 162*b* are soldered to connecting terminals on the circuit board 15.

Fitting recesses (fitting holes) 614*a* and 614*b* for fitting with projections of the corresponding connector on the host side (see a host-side connector 41 in FIG. 5) are formed inside the side wall portions 613*a* and 613*b*, i.e., on the side opposed to the projecting portions 612. The corresponding connector on the host side is formed with projections to be fitted in the fitting recesses 614*a* and 614*b* and is also formed with recesses (holes) to be fitted with the projecting portions 612*a* and 612*b*. The contact portions 162*a* of the connecting terminals 162 are connected to corresponding connecting terminals formed in the recesses of the corresponding connector on the host side.

The connector according to the parallel ATA is such that its connecting terminals are connected to the host-side connector without mutual connection of respective housings. On the other hand, housings for the connector structure according to the serial ATA are fitted with each other as described above. Therefore, when the user connects the HDD-side connector to the host-side connector, a larger force than in the connector of parallel ATA is apt to be exerted on the HDD-side connector 16. Thus, in comparison with the connector structure of parallel ATA, the connector structure of serial ATA is such that the connection between the connector 16 and the circuit board 15 is apt to be damaged.

As shown in FIG. 3, the stiffeners 17*a* and 17*b* are fitted with the side wall portions 613*a* and 613*b* outside the side wall portions, i.e., on the side opposite to the projecting portions 612 with respect to the fitting recesses 614*a* and 614*b*. The stiffeners 17 used in this embodiment are T-shaped stiffeners formed of metal. The stiffeners 17*a* and 17*b* are fitted in holes formed in the circuit board 15 and are fixed to the circuit board 15 by soldering. Head portions 171*a* and 171*b* of the T-shaped stiffeners 17*a* and 17*b* are abutted against upper surfaces (the surfaces opposite to the circuit board 15) of the side wall portions 613*a* and 613*b* and fix the housing 161 to the circuit board 15. Typically, the housing 161 is not bonded to the circuit board 15, but is firmly fixed to the circuit board through the stiffeners 17.

The stiffeners 17 used in this embodiment not only function to fix the connector 16 to the circuit board 15 but also function to restrict the movement of the connector 16 and prevent damage of the connector. When connecting (or removing) the connector 16 to (or from) the corresponding connector on the host side, a large force may be exerted on the connector 16. In particular, if a large force is applied to the connector 16 in a direction perpendicular to and away from the surface of the circuit board 15, the connector 16 moves, with a consequent likelihood of damage of the connection between the connecting terminals 162 (connecting terminals 162*b*) and the circuit board 15. The stiffener 17 used in this embodiment functions as a stopper for stopping that movement.

Figure 5:
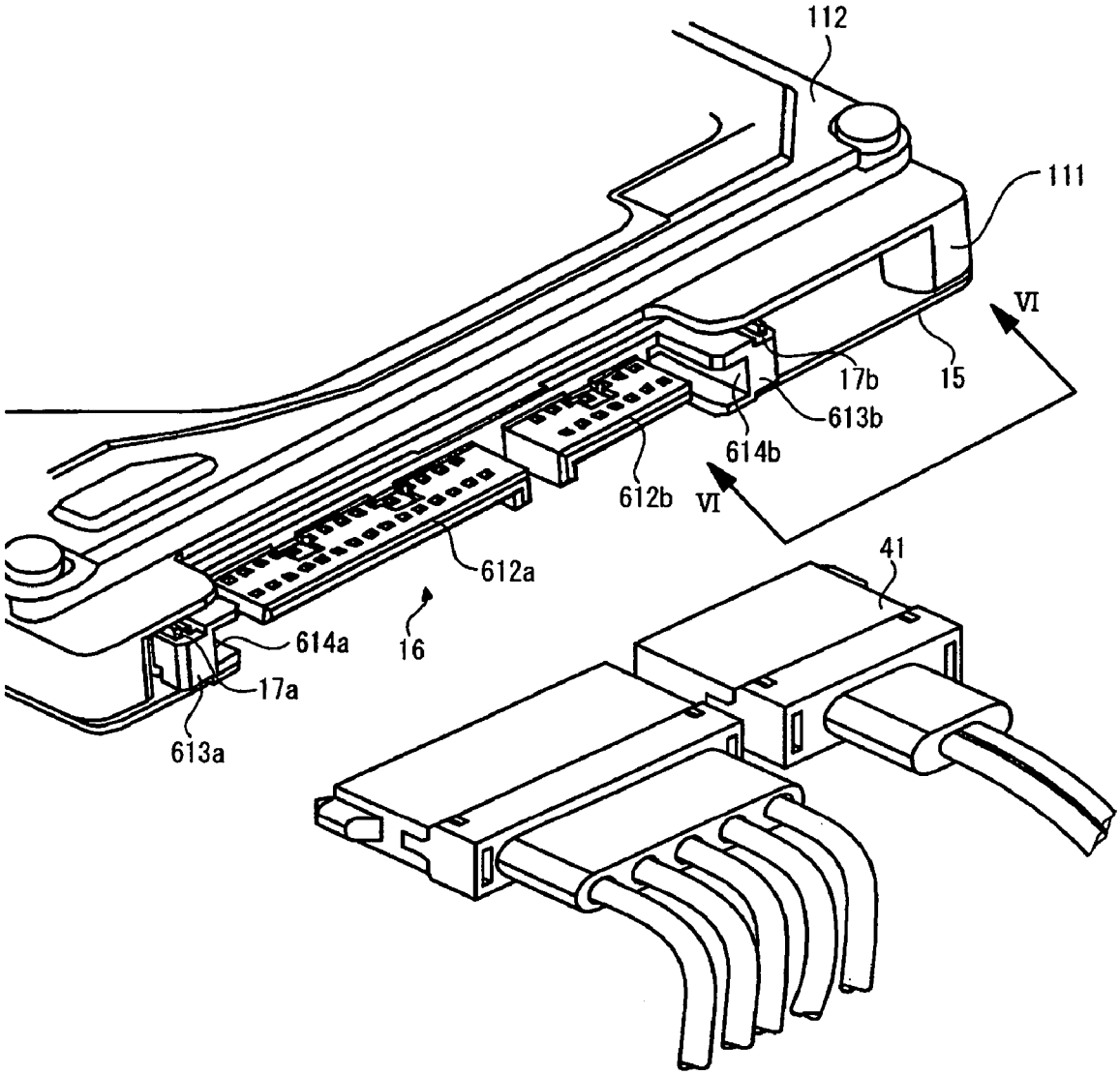
FIG. 5 is a perspective view showing a state in which a circuit board used in the embodiment is mounted on the body of the hard disk drive.

FIG. 5 is a perspective view showing a mounted state of the circuit board 15 to the HDD body 11. The circuit board 15 is disposed outside the enclosure of the HDD body 11. More particularly, the circuit board 15 is fixed with screws to an outer surface of the base 111. The circuit board 15 is fixed to the base 111 so that the connector 16 is opposed to the base 111. The connector 16 (at least a part thereof) is positioned in the space between the circuit board 15 and the base 111. The head portions 171*a* and 171*b* of the stiffeners 17*a* and 17*b* project from the surface of the housing 161 opposed to the base 111. That is, the head portions 171*a* and 171*b* of the stiffeners 17*a* and 17*b* are opposed to a part of the base 111 and are positioned between the housing 161 and the base 111.

If an external force is applied to the housing 161 (connector 16) at the time of connection to the host-side connector 41, the circuit board 15 bends and the housing 161 moves away from the surface of the circuit board 15, i.e., toward the base 111. As a result of deformation of the circuit board 15, the stiffeners 17*a* and 17*b* also move toward the base 111 together with the housing 161 and the head portions 171*a* and 171*b* of the stiffeners 17*a* and 17*b* come into abutment against the outer surface of the base 111 opposed thereto. Upon abutment of the stiffeners 17 against the opposed wall portion (base 111), the stiffeners 17 stop, whereby the deformation of the circuit board 15 and the movement of the connector 16 are stopped. Since the stiffeners 17 thus function as stoppers for the connector 16 (housing 161), it is possible to prevent damage of the connection between the connecting terminals 162 and the circuit board 15. From the standpoint of ensuring the fixing and preventing damage it is preferable that the stiffeners 17 used in this embodiment be provided on both sides of the housing 161.

Figure 6:
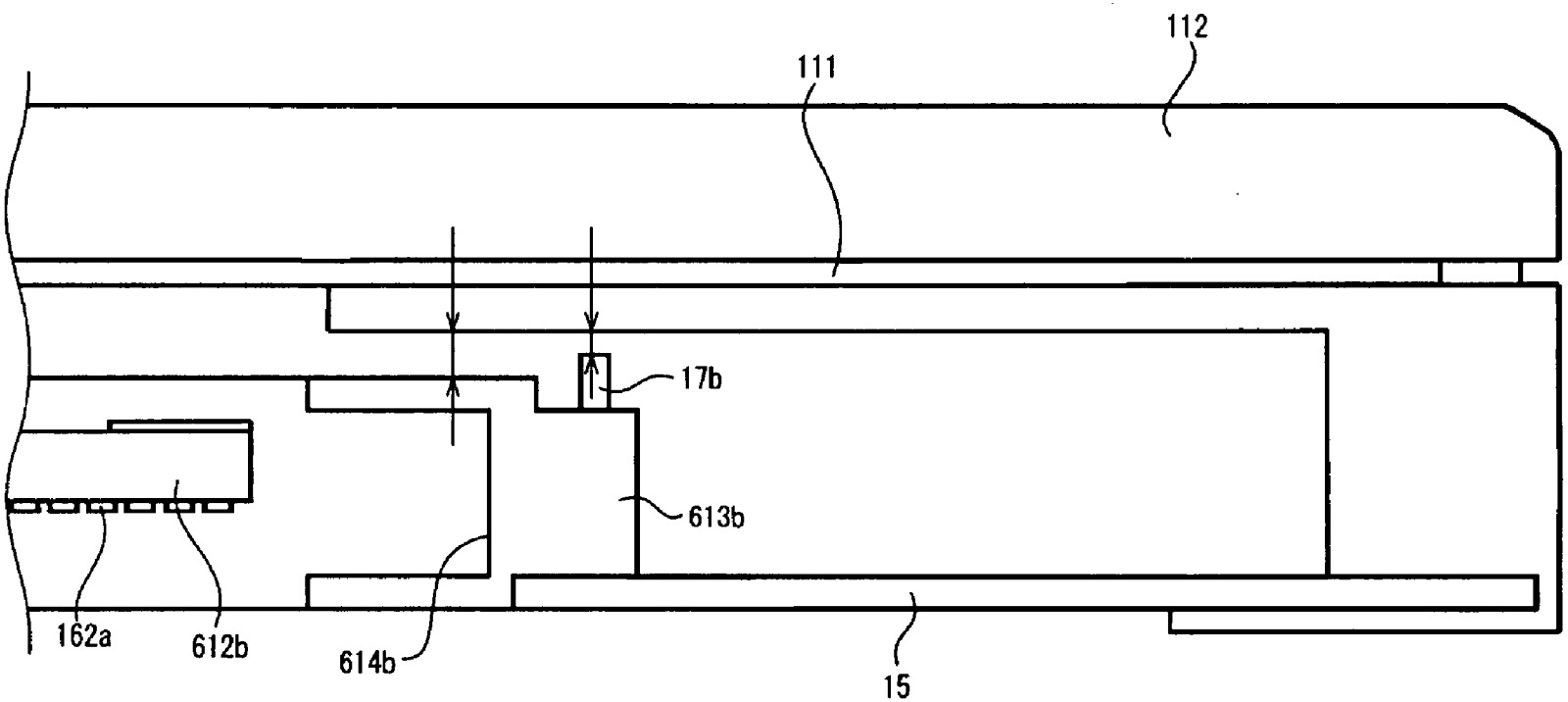
FIG. 6 is a side view of the hard disk drive, showing the portion indicated by line VI–VI' in FIG. 5.
Figure 7:
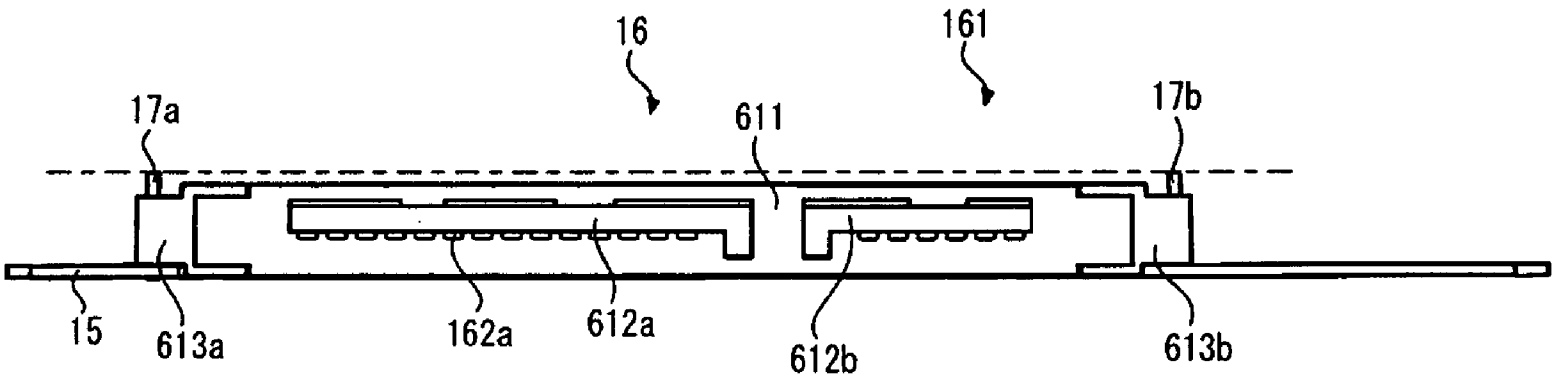
FIG. 7 is a side view showing the construction of the serial ATA connector and stiffeners as seen from an insertion port side of the connector.

FIG. 6 is a side view of the HDD 1, showing the portion indicated by line VI—VI in FIG. 5. FIG. 7 is a side view showing the construction of the connector 16 and the stiffeners 17 as seen from the insertion port side of the connector 16. As shown in FIG. 7, the stiffeners 17 project to the base 111 side from the surface of the housing 161 and the height of the top of the stiffeners 17 from the circuit board 15 is higher than a highest point of the housing 161. That is, as shown in FIGS. 6 and 7, the gap between the top of the stiffeners 17 and the base 111 is smaller than the gap between the housing 161 and the base 111. Therefore, when the connector 16 and the stiffeners 17 move toward the base 111 under the action of an external force, it is the stiffeners 17, not the connector 16 (housing 161), that are the first to contact the base 111, and thus the amount of movement of the connector 16 can be decreased effectively.

As noted above, it is preferable that the height of the top of the stiffeners 17 from the circuit board 15 be higher than the highest position of the housing (see FIG. 7). That is, it is preferable that the gap between the top of the stiffeners 17 and the base 111 opposed to the top be smaller than the smallest value of the gap between the base 111-side surface of the housing 161 and the base 111 opposed thereto.

However, the portions which move substantially in connecting the HDD-side connector and the host-side connector with each other are connection-side portions for connection with the host-side connector, i.e., the side wall portions 613*a*, 613*b* and the projecting portions 612*a*, 612*b* as portions located on the front side (the corresponding connector insertion side of the host) with respect to the base portion 611. Thus, since the top of the stiffeners 17*a* and 17*b* is higher than the side wall portions 613*a* and 613*b* (higher than the highest position of the side wall portions 613*a* and 613*b*), the amount of movement of the connector 16 can be decreased effectively and it is possible to effectively prevent damage of the connection between the connecting terminals 162 and the circuit board 15.

Although in this embodiment the wall portion against which the stiffeners 17 come into abutment is the base 111, a constructional portion other than the base 111 may be disposed at the position opposed to the stiffeners 17. It is also possible to let the stiffeners 17 be normally in abutment against the base 111. However, to avoid the application of an undesirable force to the connector 16 and the circuit board 15, it is preferable that a gap be formed between the stiffeners 17 and the base 111. A suitable size of the gap is set taking a production tolerance, etc. into account.

Figure 8:
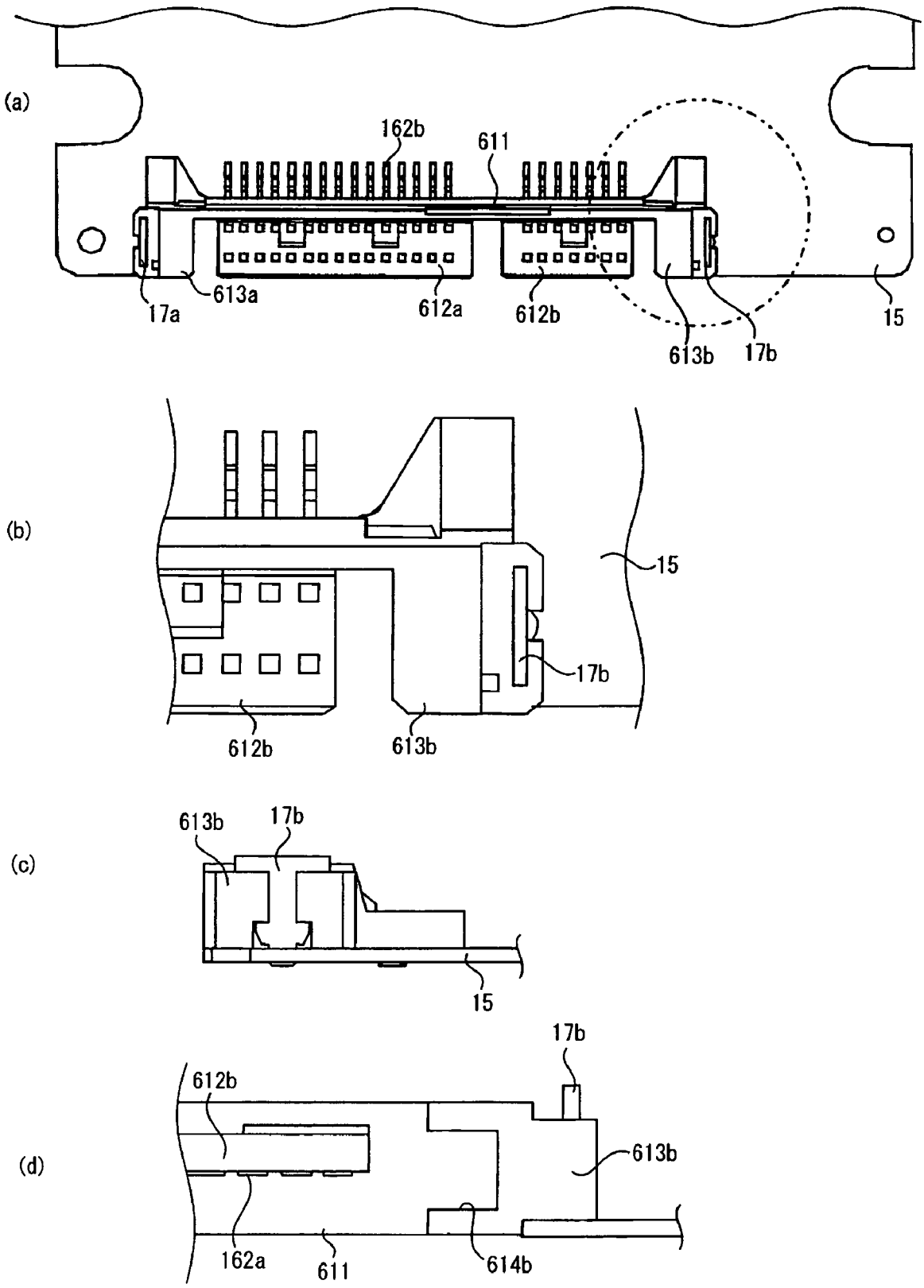
FIG. 8 shows the construction of the connector and the stiffeners.

FIG. 8 shows the construction of the connector 16 and that of the stiffeners 17, in which FIG. 8(*a*) is a plan view of the connector 16 and the stiffeners 17 as seen from the base 111 side, FIG. 8(*b*) is an enlarged diagram of the dotted line portion in FIG. 8(*a*), FIG. 8(*c*) is a side view of FIG. 8(*b*) as seen from the side wall portion 613*b* side, and FIG. 8(*d*) is a side view of FIG. 8(*b*) as seen from the corresponding connector insertion side (projecting portion 612 side) of the host. As shown in FIG. 8(*b*), the T-shaped stiffener 17*b* is fitted in a fitting hole formed in the side wall portion 613*b* of the housing 161.

As described earlier, the bottom side of the T-shaped stiffener 17*b* passes through a through hole formed in the circuit board 15 and is connected and fixed to the circuit board 15 by soldering. In the manufacturing stage, the stiffener 17*b* can be inserted into the fitting hole from above the housing 161. The head 171*b* on the top side of the stiffener 17*b* is larger than the diameter of the fitting hole formed in the side wall portion 613*b* and is in abutment against the base 111-side surface of the side wall portion 613*b*. Thus, from the standpoint of easy manufacture and sureness of fixing, it is preferable that the connector 16 be fixed by abutment of the head portions 171*a* and 171*b* of the stiffeners 17*a* and 17*b* against the upper surface of the housing 161.

As shown in FIG. 8(*b*), the stiffener 17*b* is disposed within the side wall portion 613*b*. Therefore, in a direction where the connection terminal 162 are arranged (in a direction along one side of the circuit board 15), the stiffener 17*b* is disposed at a position opposed to the projecting portions 612 and the contact portions 162*a* of the connecting terminals 162. As noted above, an external force at the time of connection of the connector 16 is exerted on the portion ahead of the base portion 611, so that the portion moves substantially.

As shown in FIG. 8(*d*), since the stiffener 17*b* is disposed in the aforesaid position, a slight movement of the connector 16 toward the base 111 causes the stiffener 17*b* and the base 111 to come into abutment against each other, whereby the damage of connection between the connecting terminals 162 and the circuit board 15 can be prevented effectively. Further, the connector 16 can be fixed to the circuit board 15 effectively against an external force. Although the stiffener 17*b* has been described with reference to FIG. 8, the stiffener 17*a* is also formed in the same shape and position as the stiffener 17*b*.

As described above, from the standpoint of occupied area of the circuit board 15 or fixing of the housing 161, it is preferable that the stiffeners 17 be fitted with the housing 161. However, the stiffeners 17 may be disposed outside the housing 161. For example, an L-shaped stiffener may be disposed so as to be in contact with outer surfaces of both side wall portions 613 of the housing 161 and a corner of an upper surface of the housing 161 and the bent portion of the L-shaped stiffener may be fitted with each other. The stiffeners 17 may be designed in any shape insofar as the shape adopted can fix the connector 16, e.g., a shape having a circular or quadrangular head, in addition to T and L shapes. From the standpoint of strength it is preferable that the stiffeners be formed of metal, but the stiffeners may be formed of any other material such as resin.

In this embodiment the stiffeners 17 for fixing the connector 16 to the circuit board 15 also function as stoppers for stopping the movement of the connector 16 (housing 161). From the standpoint of reducing the number of parts, attaining a simple construction, and ensuring the fixing of the connector 16, it is preferable for the stiffeners 17 to function also as stoppers. However, a stopper separate from the stiffeners 17 may be mounted on the circuit board 15.

For example, a columnar stopper may be fixed onto the circuit board 15 outside the housing 161. Further, a stopper may be formed integrally with the housing 161. For example, projections may be formed on the upper surfaces (the base 111-side surfaces) of the side wall portions 613 and be allowed to function as stoppers for abutment against the base 111. In the case of thus using stoppers formed separately from the stiffeners, it is desirable to use stiffeners or any other alternative fixing means for fixing of the housing 161 to the circuit board 15.

Figure 9:
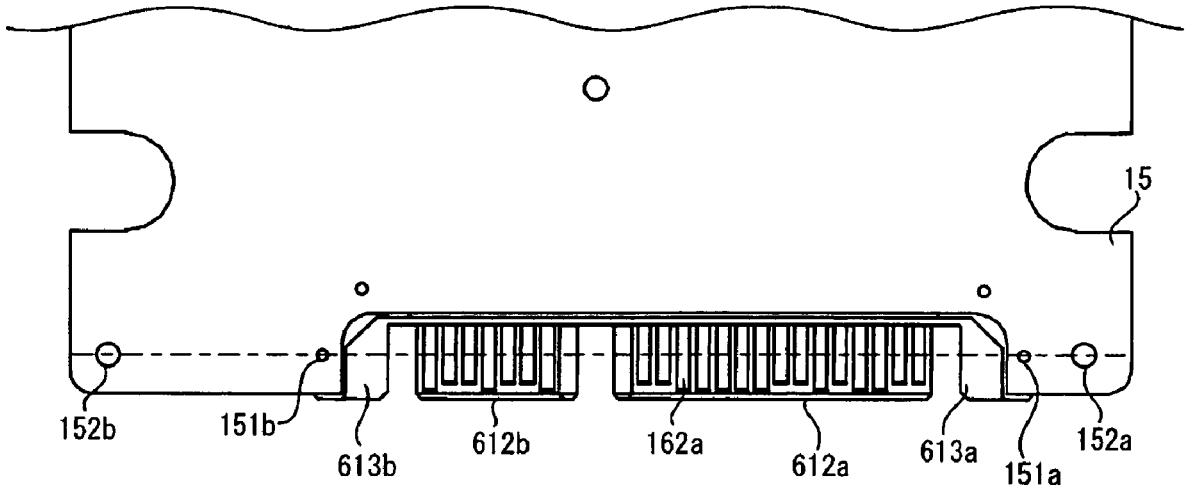
FIG. 9 is a plan view of the circuit board as seen from the side opposite to a base.

As described above, from the standpoint of fixing the connector 16 more firmly to the circuit board 15, it is preferable that the stiffeners be disposed on the front side of the connector 16, i.e., at a position close to an end of the circuit board 15. This is true also from the standpoint of diminishing the range of movement of the connector 16. FIG. 9 is a plan view of the circuit board 15 as seen from the side opposite to the base 111. FIG. 9 shows a relation between the positions of through holes 151*a* and 151*b* for insertion therein of the stiffeners 17*a* and 17*b* and the positions of tapped holes 152*a* and 152*b* for insertion therein of screws for fixing of the circuit board 15 to the base 111.

The tapped holes 152*a* and 152*b* are formed respectively in both corner portions on one side of the circuit board 15 where the connector 16 is fixed. In FIG. 9, central positions of the through holes 151*a* and 151*b* to be fitted with the stiffeners 17*a* and 17*b* lie on a line joining central positions of the tapped holes 152*a* and 152*b*. A positional relation of the fixed point of the connector 16 to the through holes 151*a*,

151*b* and the tapped holes 152*a*, 152*b* or the screws inserted into the tapped holes 152*a*, 152*b* is an important factor.

Figure 10:
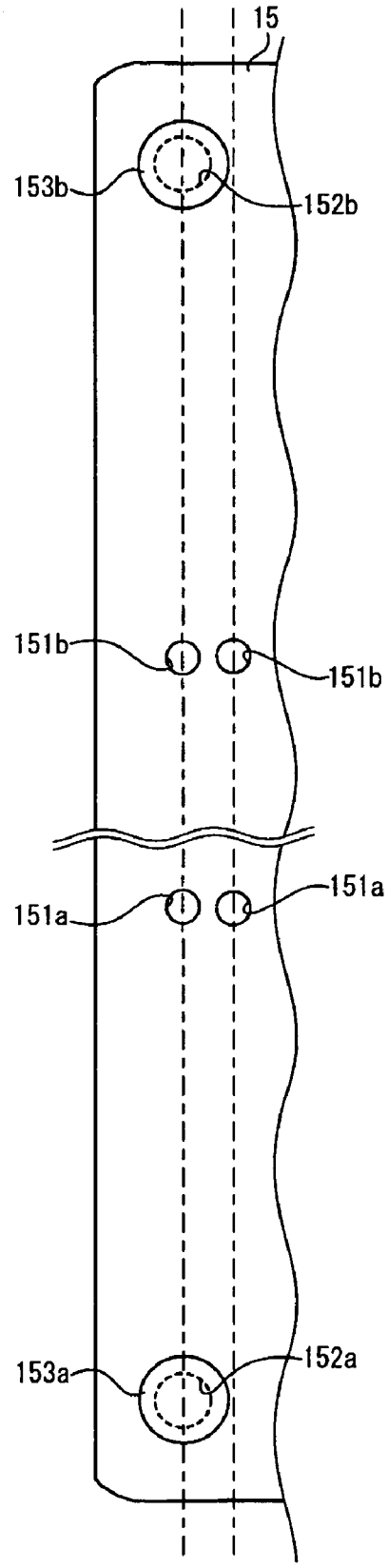
FIG. 10 shows preferred positions of through holes in the circuit board to be fitted with the stiffeners.
Figure 11:
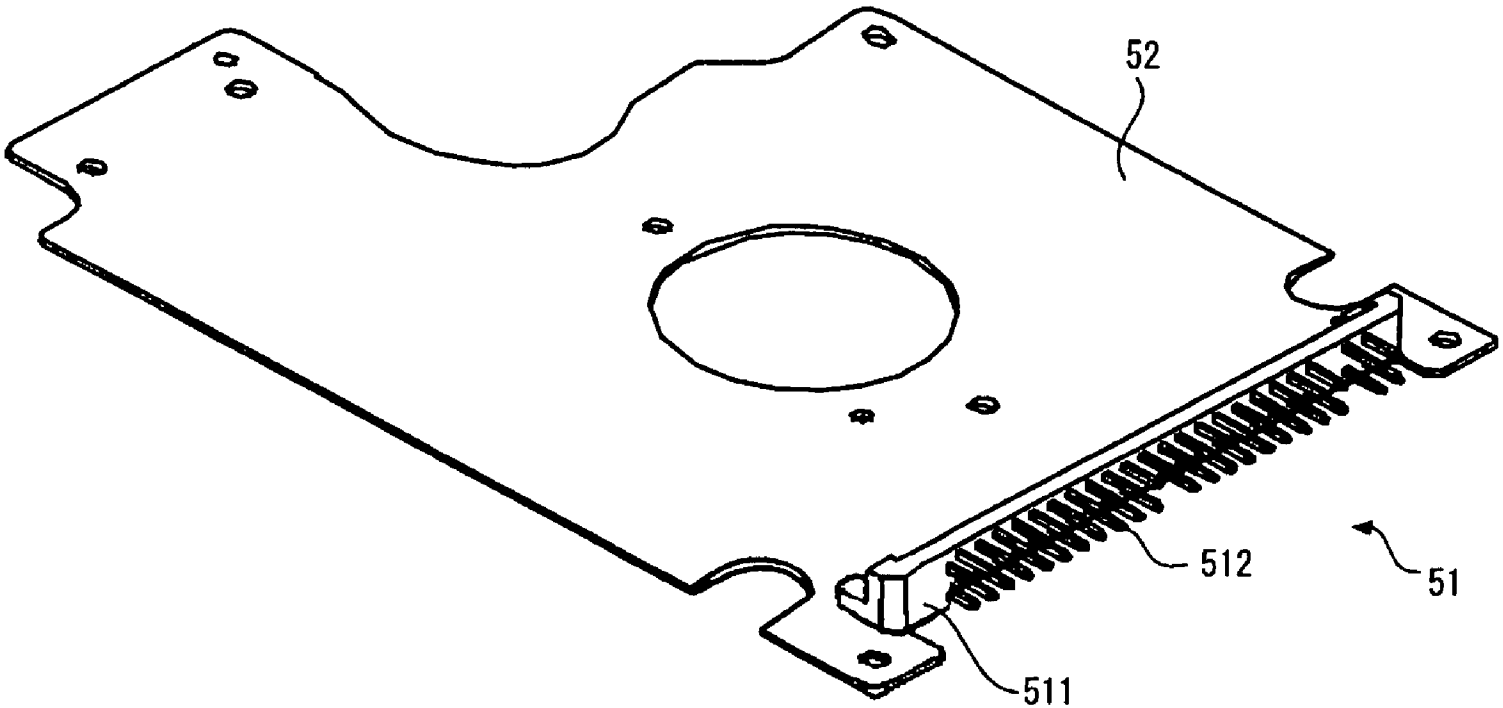
Fig.11 (PRIOR ART)
FIG. 11 is a perspective view showing the construction of a conventional parallel ATA connector.

FIG. 10 shows preferred positions of the through holes 151*a* and 151*b* to be fitted with the stiffeners 17*a* and 17*b*. It is preferable that central positions of the through holes 151*a* and 151*b* lie on a line joining head ends of screws 153*a* and 153*b* which are located inside the circuit board 15 (the side opposite to the circuit board end) or on the end side of the circuit board 15 relative to the line. When an external force is applied in a direction in which the connector 16 tends to leave the circuit board 15 at the time of connection, the circuit board 15 will be deformed. The screws 153*a* and 153*b* for fixing the circuit board 15 to the base 111 are located closest to the connector 16 and can be regarded as fulcrums at the time of deformation of the circuit board 15.

It is preferable that the stiffeners 17*a* and 17*b* for fixing the connector 16 (housing 161) to the circuit board 15 be fixed to the circuit board 15 on the board end side relative to the positions of the aforesaid fulcrums. Therefore, it is preferable that central positions of the through holes 151*a* and 151*b* lie on a line joining innermost points, from the circuit board end, of the heads of the screws 153*a* and 153*b* at both corner portions corresponding to the fulcrum ends inside the circuit board 15 or on the circuit board end side relative to the line. More preferably, the central positions of the through holes 151*a* and 151*b* lie on a line joining the central positions of the screws 152*a* and 152*b* as fulcrum centers or on the circuit board end side relative to the line.

On the other hand, if the through holes 5*la* and 151*b* are too close to the circuit board end, it is likely that the circuit board 15 may be cracked. In view of this point the distance of the through holes 151*a* and 151*b* from the circuit board end is determined so as to avoid cracking of the circuit board 15. Preferably, the distance between the center of each of the through holes 151*a* and 151*b* and the circuit board end is set at about 0.5 mm or more. As noted above, the positions of the through holes 151*a* and 151*b* can be applied to stiffeners not functioning as stoppers, whereby the connector 16 can be fixed to the circuit board 15 more firmly. Further, by the application to stiffeners 17 which function as stoppers, the stopper function is promoted. In the case where the circuit board 15 has a sufficient thickness, the holes fitted with the stiffeners need not extend through the circuit board 15.

Thus, according to this embodiment, the range of movement of the connector caused by an external force is diminished by the stoppers, whereby it is possible to prevent damage of the connection between the connector and the circuit board at the time of connection. Moreover, since the stiffeners for fixing the connector to the circuit board are fixed to predetermined positions of the circuit board, the fixing of the connector to the circuit board is improved and it is possible to suppress damage of the connection between the circuit board and the connector.

The connecting structure according to the present invention has been described above with reference as an example to the connector conforming to the Serial ATA Interface of the HDD. The connecting structure according to the present invention exhibits an outstanding effect in the serial ATA connector. However, the present invention is applicable also to other types of connectors, including a parallel ATA connector.

It is to be understood that the above description is intended to be illustrative and not restrictive. Many embodiments will be apparent to those of skill in the art upon reviewing the above description. The scope of the invention should, therefore, be determined not with reference to the above description, but instead should be determined with reference to the appended claims alone with their full scope of equivalents.

What is claimed is:

1. A data storage device comprising:

a data storage device body having a wall portion;

a circuit board mounted on said data storage device body;

a connector mounted on said circuit board, said connector having a housing and a plurality of connecting terminals disposed in said housing; and a stopper fitted with said housing, and wherein said stopper is adapted to come into abutment against the wall portion to stop movement of the housing when an external force causes the housing to move in a direction having a component perpendicular from a surface of said circuit board.

2. A data storage device according to claim 1, wherein said stopper is formed separately from said housing, is fixed to said circuit board, is fitted with said housing, and fixes said connector to said circuit board.

3. A data storage device according to claim 2, wherein the height of said stopper from said circuit board is higher than a highest position of said housing from said circuit board.

4. A data storage device according to claim 2, wherein said stopper is fitted in a hole formed in said housing.

5. A data storage device according to claim 2, wherein said housing has a base portion to which said plural connecting terminals are fixed and a side wall portion formed sideways of said base portion, said plural connecting terminals are arranged on said base portion and have contact portions projecting forward from the base portion so as to be connected to a corresponding connector, and said stopper is fitted in a hole formed in said side wall portion and said stopper has a component perpendicular to said contact portions in the direction in which said plural connecting terminals are arranged.

6. A data storage device according to claim 5, wherein said side wall portion has a fitting hole for fitting therein of a housing of the corresponding connector which is connected to said connector, said fitting hole being formed at a position with a component perpendicular to said contact portions, and the height of said stopper from said circuit board is higher than a highest position of said side wall portion from said circuit board.

7. A data storage device according to claim 2, wherein a housing of a corresponding connector connected to said connector and the housing of said connector are fitted together.

8. A data storage device according to claim 2, wherein said data storage device body has an enclosure for receiving a recording medium therein, said circuit board is disposed on an outer surface of said enclosure so that said connector is set apart from said enclosure, and the wall portion is a part of said enclosure.

9. A data storage device according to claim 8, wherein said connector is disposed on one side of said circuit board, said circuit board is fixed to said enclosure with screws at both corner portions of said one side, and a hole for fitting therein of said stopper is formed in said circuit board so that the center thereof is positioned on a line joining positions innermost from the circuit board end on said one side where screw heads in said both corner portions are located, or on said circuit board end side relative to said line.

10. A data storage device according to claim 9, wherein the center of said stopper fitting hole formed in said circuit board is positioned on a line joining the centers of holes formed in said circuit board for fitting therein of the screws in said both corner portions, or on said circuit board end side relative to said line.

11. A data storage device comprising:

a data storage device body having an enclosure for receiving a recording medium therein;

a circuit board disposed on a surface of said enclosure;

a connector disposed on one side of said circuit board, said connector having a housing and a plurality of connecting terminals disposed in said housing; and a stiffener fixed to said circuit board and fitted with said housing, said stiffener fixing said connector to said circuit board, wherein said stiffener is adapted to come into abutment against a wall portion of said enclosure to stop movement of the housing when an external force causes the housing to move in a direction having a component perpendicular from a surface of said circuit board;

wherein said circuit board is fixed to said enclosure with screws at both corner portions on said one side, and a hole for fitting therein of said stiffener is formed in said circuit board so that the center thereof is positioned on a line joining positions innermost from the circuit board end on said one side where screw heads in said both corner portions are located, or on said circuit board end side relative to said line.

12. A data storage device according to claim 11, wherein the center of said stiffener fitting hole formed in said circuit board is positioned on a line joining the centers of holes formed in said circuit board for fitting therein of the screws in said both corner portions, or on said circuit board end side relative to said line.

13. A data storage device according to claim 11, wherein the height of said stiffener from said circuit board is higher than a highest position of said housing from said circuit board.

14. A connector fixed onto a circuit board at a position set apart from an enclosure which is for receiving therein a recording medium of a data storage device, said circuit board being disposed on a surface of said enclosure, said connector comprising:

a housing;

a plurality of connecting terminals disposed in said housing; and a projecting member fitted in a hole formed in said housing and projecting higher than a highest position of a surface of said housing on the side opposite to a mounting surface of said housing for mounting to said circuit board, wherein said projecting member is adapted to come into abutment against a wall portion of said enclosure to stop movement of the housing when an external force causes the housing to move in a direction having a component perpendicular from a surface of said circuit board.

15. A magnetic disk drive comprising:

an enclosure which receives a magnetic disk therein and which has a base and a top cover;

a circuit board disposed outside said base and with a control circuit mounted thereon;

a connector mounted on said circuit board, said connector having a housing and a plurality of connecting terminals disposed in said housing; and a stiffener fixed to said circuit board and fixing said housing to said circuit board;

wherein said housing has a base portion on which said plural connecting terminals are arranged and a side wall portion formed sideways of said base portion, said plural connecting terminals have contact portions projecting forward from said base portion so as to be connected to a host-side connector, said stiffener is fitted in a hole formed in said side wall portion, has a component perpendicular to said contact portions in the direction in which said plural connecting terminals are arranged, and projects from a surface of said side wall portion in a direction with a component perpendicular to said base, wherein said stiffener is lateral to the forward projecting contact portions, and the distance between said stiffener and the base of said enclosure is smaller than a smallest gap between said side wall portion and the base of said enclosure.

16. A magnetic disk drive according to claim 15, wherein said connector is disposed on one side of said circuit board, said circuit board is fixed to said enclosure with screws at both corner portions of said one side, and a hole for fitting therein of said stiffener is formed in said circuit board so that the center thereof is positioned on a line joining positions innermost from the circuit board end on said one side where screw heads in said both corner portions are located, or on said circuit board end side relative to said line.

17. A magnetic disk drive according to claim 16, wherein the center of said stiffener fitting hole formed in said circuit board is positioned on a line joining the centers of holes formed in said circuit board for fitting therein of the screws in said both corner portions, or on said circuit board end side relative to said line.

18. A data storage device according to claim 1, wherein a portion of said connector housing is situated between a portion of the circuit board and the wall portion of the data storage device body.

* * * * *